US008806772B1

(12) United States Patent
Schaefer, Jr.

(10) Patent No.: US 8,806,772 B1
(45) Date of Patent: Aug. 19, 2014

(54) GRAIN DRYING SYSTEM

(75) Inventor: Donald B. Schaefer, Jr., Blue Springs, MO (US)

(73) Assignee: C2AG, LLC, Blue Springs, MO (US)

( * ) Notice: Subject to any disclaimer, the term of this patent is extended or adjusted under 35 U.S.C. 154(b) by 579 days.

(21) Appl. No.: 12/391,906

(22) Filed: Feb. 24, 2009

(51) Int. Cl.
*F26B 19/00* (2006.01)
*F26B 3/00* (2006.01)

(52) U.S. Cl.
USPC ..... 34/89; 34/491

(58) Field of Classification Search
USPC ..... 34/491, 502, 89; 73/29.01, 855, 504.14, 73/431, 866.5, 73; 374/100, 208.16, 28, 4, 374/109, 141, 120, 54, 137, 112, 115, 110, 374/166, 1
See application file for complete search history.

(56) References Cited

U.S. PATENT DOCUMENTS

| | | | | |
|---|---|---|---|---|
| 2,655,734 | A * | 10/1953 | Ohlheiser | 34/566 |
| 3,563,460 | A * | 2/1971 | Nine | 236/49.3 |
| 4,035,928 | A | 7/1977 | Sietmann et al. | |
| 4,293,854 | A | 10/1981 | Gookins et al. | |
| 4,522,335 | A | 6/1985 | Kallestad et al. | |
| 4,583,300 | A * | 4/1986 | Mast | 34/557 |
| 4,599,809 | A | 7/1986 | Parkes | |
| 4,688,332 | A | 8/1987 | Kallestad et al. | |
| 4,896,795 | A | 1/1990 | Ediger et al. | |
| 6,134,953 | A * | 10/2000 | Verheecke | 73/73 |
| 6,530,160 | B1 | 3/2003 | Gookins | |
| 6,747,461 | B2 | 6/2004 | Corak et al. | |
| 6,986,294 | B2 | 1/2006 | Fromme et al. | |
| 7,240,029 | B2 | 7/2007 | Kallestad | |
| 7,243,857 | B2 * | 7/2007 | Kallestad | 236/49.3 |
| 2005/0252380 | A1 * | 11/2005 | Gastaldi et al. | 96/406 |
| 2009/0262781 | A1 * | 10/2009 | Shumaker et al. | 374/141 |

FOREIGN PATENT DOCUMENTS

KR 2003034829 A * 5/2003

* cited by examiner

*Primary Examiner* — Kenneth Rinehart
*Assistant Examiner* — John McCormack
(74) *Attorney, Agent, or Firm* — Erickson, Kernell, Derusseau & Kleypas, LLC

(57) ABSTRACT

A grain drying system includes a master control unit external to the grain storage bin which is preprogrammed with a desirable grain moisture content or EMC. Condition sensor assemblies mounted within the grain bin determine the relative humidity and the temperature of the grain within the grain bin. Also, sensors mounted in the bin's plenum determine temperature, relative humidity and air pressure. A weather station mounted externally of the grain bin determines the outside air temperature and relative humidity. Depending on the conditions determined by the sensor assemblies and the weather station, the master control unit selectively activates the grain bin's drying fan when needed and when it is efficient and effective to do so. A radio or cellular modem allows for communication of the grain's condition. The internal sensor assemblies are preferably secured to flexible cables hung within the grain bin. The cable and rigid rod-like members support the sensors. The sensors may be secured in a spaced relationship along the cable so that the grain condition can be determined throughout the grain bin.

17 Claims, 6 Drawing Sheets

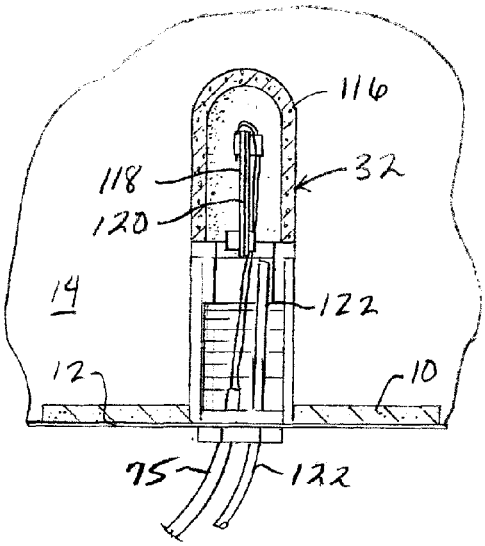
Fig. 11
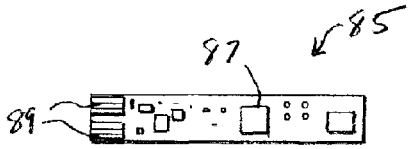
Fig. 13
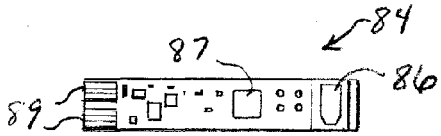
Fig. 14
Fig. 12
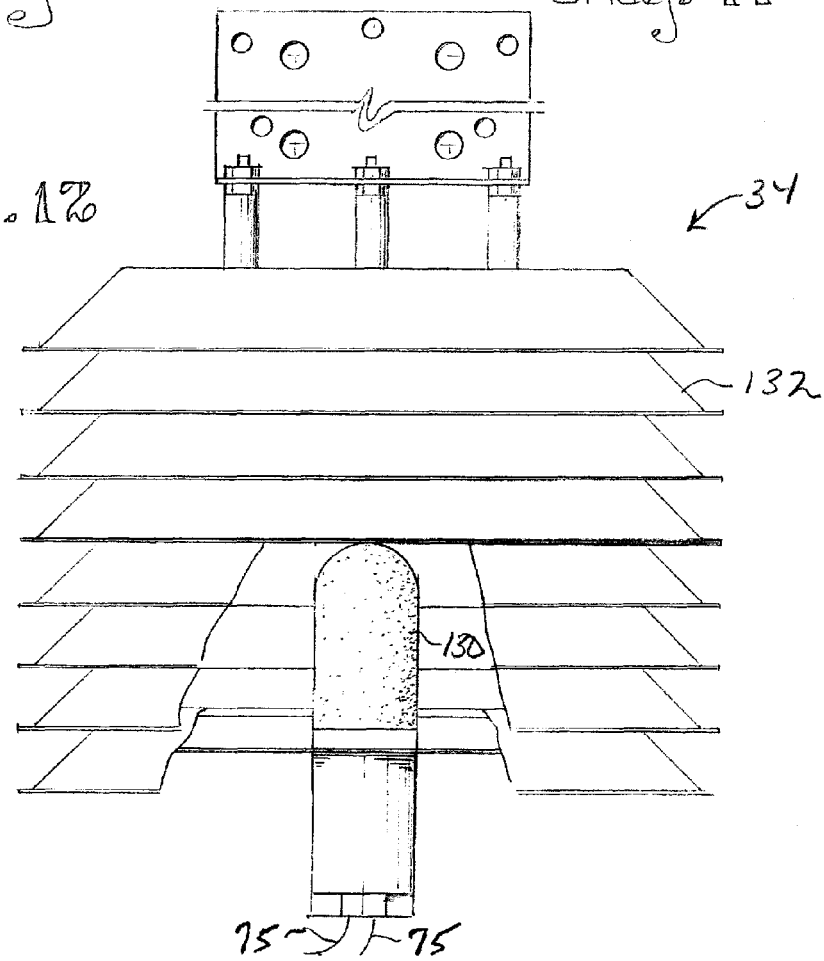

GRAIN DRYING SYSTEM

BACKGROUND OF THE INVENTION

An important need exists to dry grain quickly and effectively after harvest to retain maximum quality, to attain a moisture content sufficiently low to minimize infestation by insects and microorganisms (e.g., bacteria, fungi, etc.), to prevent germination and to maximize consumer acceptability of appearance and other organoleptic properties.

Grains are hydroscopic and will lose or gain moisture until equilibrium is reached with the surrounding air. Grains will dry until they reach their equilibrium moisture content (EMC). The EMC is dependent on the relative humidity and the temperature of the air. The relationship between EMC, relative humidity and temperature for many grains has been modeled by researchers: the results have been summarized in Brooker et al. (1974), Drying Cereal Grains, Westport: The Avi Publishing Company, Inc., 265 pp. For instance, EMC's for certain grains are shown in the chart immediately below.

| | Relative Humidity (%) | | | | | | | |
|---|---|---|---|---|---|---|---|---|
| | 30 | 40 | 50 | 60 | 70 | 80 | 90 | 100 |
| Grain | Equilibrium Moisture Content (% wb*) at 25° C. | | | | | | | |
| Barley | 8.5 | 9.7 | 10.8 | 12.1 | 13.5 | 15.8 | 19.5 | 26.3 |
| Shelled Maize | 8.3 | 9.8 | 11.2 | 12.9 | 14.0 | 15.6 | 19.6 | 23.8 |
| Paddy | 7.9 | 9.4 | 10.8 | 12.2 | 13.4 | 14.8 | 16.7 | — |
| Milled Rice | 9.0 | 10.3 | 11.5 | 12.6 | 12.8 | 15.4 | 18.1 | 23.6 |
| Sorghum | 8.6 | 9.8 | 11.0 | 12.0 | 118 | 15.8 | 18.8 | 21.9 |
| Wheat | 8.6 | 9.7 | 10.9 | 11.9 | 13.6 | 15.7 | 19.7 | 25.6 |

*wet basis

Source: Brooker et al. (1974)

There are two basic mechanisms involved in the drying process: the migration of moisture from the interior of an individual grain to the surface and the evaporation of moisture from the surface to the surrounding air. The rate of drying is determined by the moisture content and the temperature of the grain and the temperature, the relative humidity and the velocity of the air in contact with the grain. In general, higher airflow rates, higher air temperatures and lower relative humidities increase drying speed. The rate of moisture movement from high moisture grain to low relative humidity air is rapid. However, the moisture movement from wet grain to moist air may be very small or nonexistent. Also, higher airflow rates generally result in higher drying rates.

Traditionally, grain crops were harvested during a dry period or season and simple drying methods such as sun drying were used. However, maturity of the crop does not always coincide with a suitably dry period. Furthermore, the introduction of high-yielding varieties, irrigation, and improved farming practices has led to the need for alternative drying practices to cope with the increased production, and grain harvested during the wet season as a result of multi-cropping.

Among other techniques, in-line dryers have been used for drying the grain. However, these use high amounts of fuel and the dryers act like an oven and tend to cook out all of the moisture and over dry and crack the grain. As a result, it has become common for grain to be stored in bins and dried by mechanically moving air over and through the grain. This method is referred to as the "in-bin natural air drying" technique.

The in-bin natural air drying technique has several advantages. It can increase the quality of the harvested grain by reducing crop exposure to weather and reduce harvesting losses, including head shattering and cracked kernels. It also reduces the dependency on weather conditions for harvest and allows more time for post-harvest field work.

However, current in-bin natural air drying systems have several disadvantages. Grains can only be stored without significant deterioration for a period of time depending on the storage conditions, such as temperature and relative humidity. Thus, the EMC must be attainable within that period of time and thereafter maintainable. Drying fans are costly to operate: they should operate when the relative humidity level is low and temperature levels are generally warm. For instance, it is useless to run fans if it is raining. Also, hot spots, i.e., grain degradation, in the grain are difficult to prevent. Sensors for determining the condition of the grain placed throughout the bin help prevent hot spots. Also, it is preferable for the drying system to be centrally controlled, with remote access.

SUMMARY OF THE INVENTION

The improved grain drying system includes a master control unit external to the grain storage bin, which is preprogrammed with a desirable grain moisture content or EMC. Condition sensor assemblies mounted within the grain bin, and extending into the mass of stored grain, determine the relative humidity and the temperature of the grain within the grain bin. Also, sensors mounted in the bin's plenum determine temperature, relative humidity and air pressure. A weather station mounted externally of the grain bin determines the outside air temperature and relative humidity. Depending on the temperature and relative humidity of the atmospheric air and the temperature and relative humidity of the air in the mass of grain to be dried as determined by the sensor assemblies and the weather station, the master control unit selectively activates the grain bin's drying fan when needed and when it is efficient and effective to do so to achieve relatively efficient drying of the grain. A radio or cellular modem allows for communication of the grain's condition to a user's personal computer or a remote data center.

The internal sensor assemblies are preferably secured to flexible cables hung or suspended within the grain bin at different levels at which the sensor assemblies will be surrounded by grain stored in the bin. The cable and rigid rod-like members support the sensors. The sensors may be secured in a spaced relationship along the cable so that the grain condition can be determined throughout the grain bin. Preferably, one cable's sensors all determine the relative humidity and at least one cable's sensors determine the temperature of the grain throughout the bin. The use of multiple cables with multiple sensors aids in accurately determining the grain's condition throughout the bin.

A protective covering extends around each cable and the sensors mounted thereon. With a relative humidity sensor, the protective covering includes an opening that is substantially aligned with the sensor to facilitate the sensor's determination of the relative humidity. A filter member is sandwiched between each of the humidity sensors and the protective covering openings, to protect the sensors from particulate matter. A second protective covering extends around each of the sensing cables between adjacent sensors, with the lower end of the first protective covering extending over the upper end of the second protective covering and the lower end of the second protective covering extending over the upper end of the first protective covering, to further protect the sensor from grain particulate.

Various objects and advantages of this invention will become apparent from the following description taken in relation to the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 4 is a flow chart showing the grain drying system's control processing;

FIG. 11 is a front sectional view of a plenum sensor of the grain drying system mounted in the grain bin;

FIG. 12 is a front view of a weather station of the grain drying system partially broken away to show the weather sensor therein;

FIG. 13 is a top view of a temperature sensor board of the grain drying system;

FIG. 14 is a top view of a moisture sensor board of the grain drying system.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
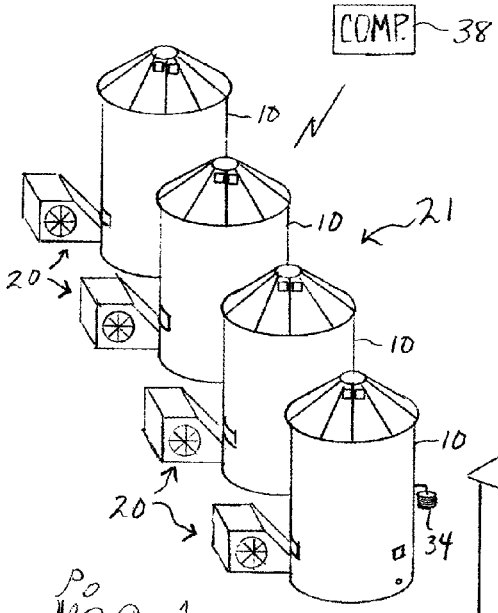
FIG. 1 is a perspective of a cluster of grain storage bins interconnected in accordance with the grain drying system of the present invention, with the remote, off-site communication shown diagrammatically.
Figure 2:
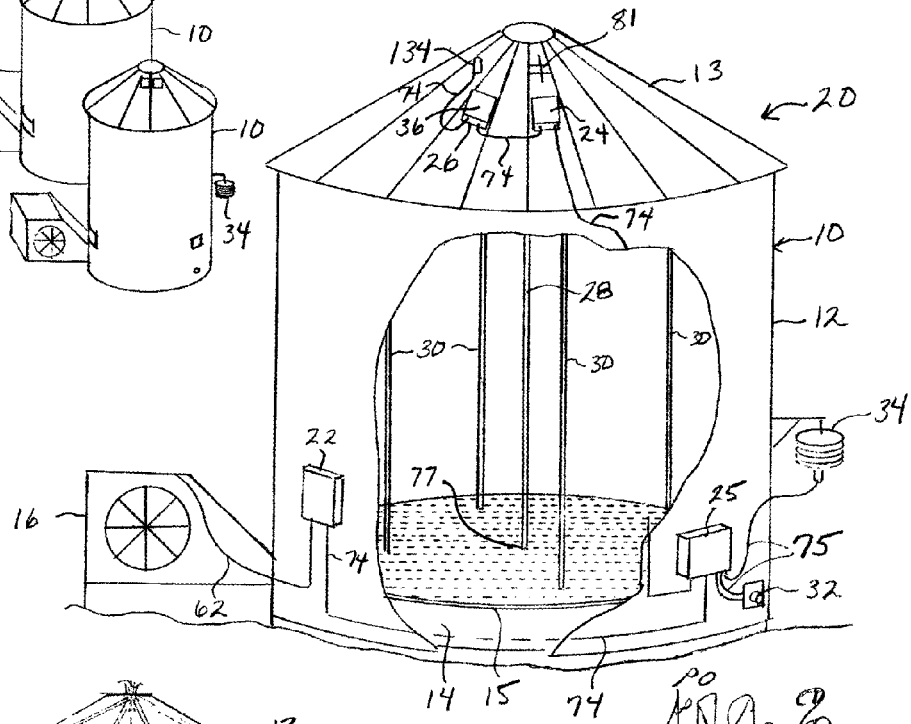
FIG. 2 is an enlarged, perspective view of one of the grain bins of FIG. 1, broken away to show the temperature and moisture cables of the grain drying system therein and with the grain removed for clarity.
Figure 3:
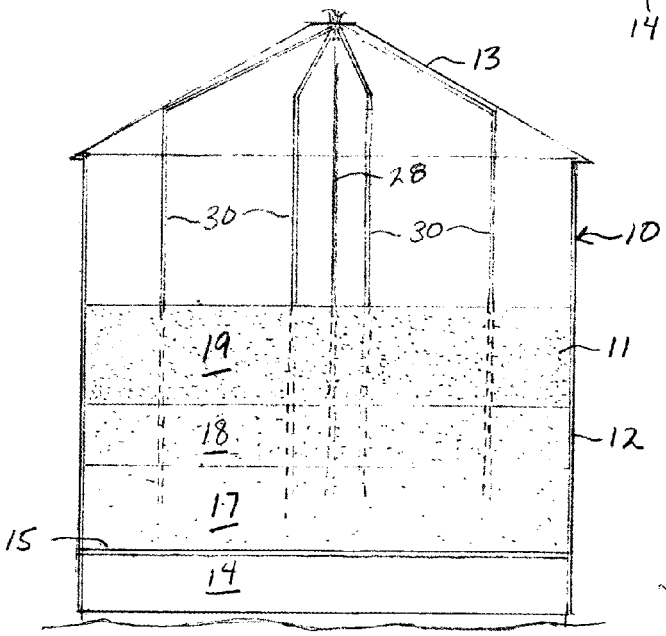
FIG. 3 is an enlarged, partial section of one of one of the grain bins of FIG. 1 with the components of the grain drying system external thereto removed for clarity, showing the cables and the grain stored therein.
Figure 2:
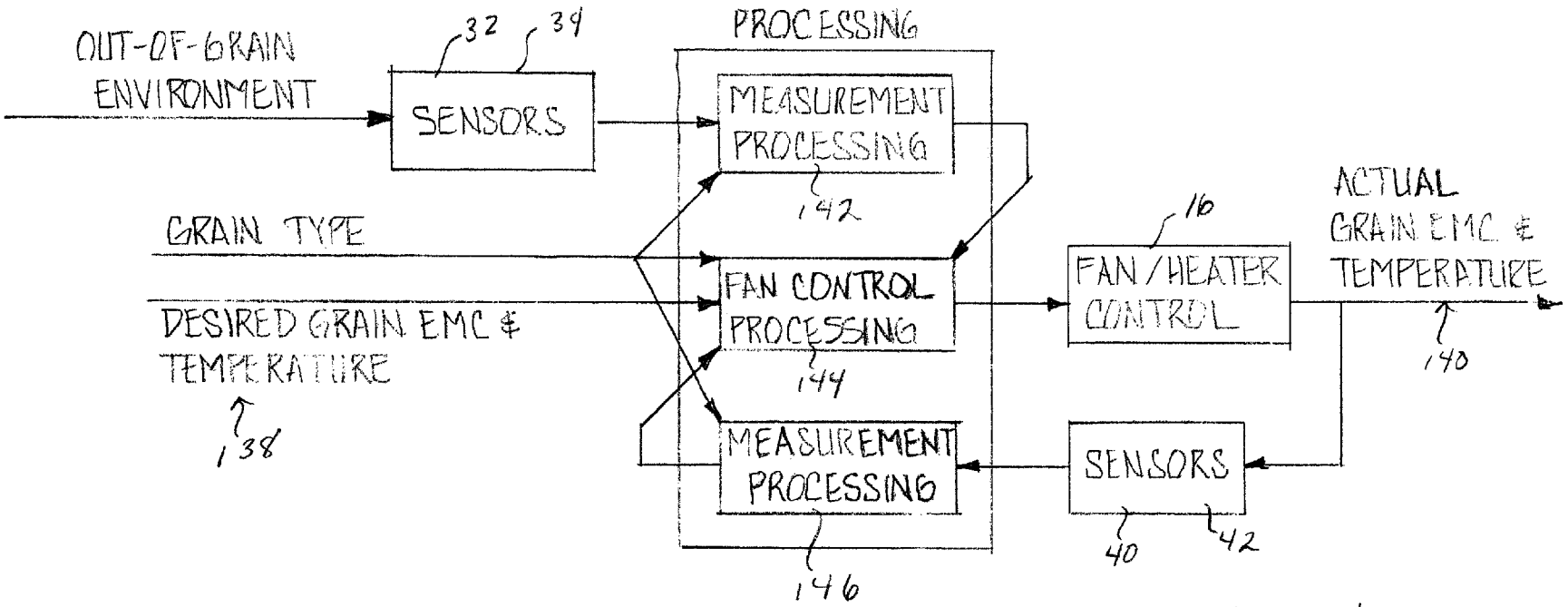

Now, referring to the drawings and specifically FIGS. 1-3, conventional grain bins 10 for storing harvested grain 11 are shown which have been modified to include a grain drying control system 20 of the present invention. Each bin 10 has a side wall 12, a roof 13 and a plenum chamber 14 formed at the bottom of the bin 10, covered by a perforated floor 15. One or more fans 16 (and/or an optional heater(s), not shown) are installed outside each grain bin 10 adjacent the plenum chamber 14 to blow atmospheric or ambient air into the chamber 14 through the perforated floor 15 to dry or aerate the grain 11. As the grain 11 dries, it forms zones, represented diagrammatically by zones 17, 18 and 19 as shown in FIG. 3. The dry grain 17 extends upwardly from the floor 15, the wet grain 19 has been most recently harvested and is nearest to the top of the bin 10, and the drying grain 18 is sandwiched between the dry grain 17 and the wet grain 19.

Figure 7:
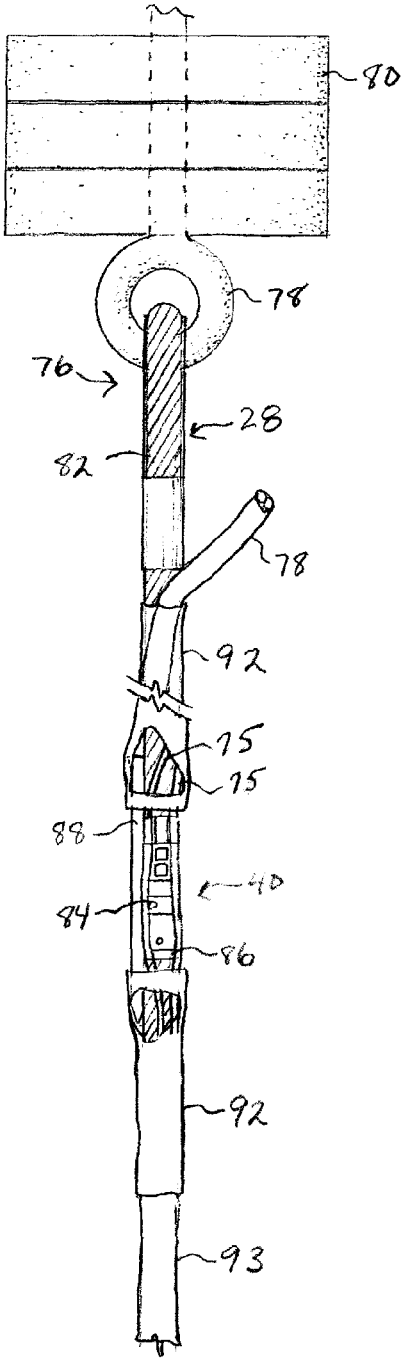
FIG. 7 is a fragmentary front plan view of a relative humidity cable of the grain drying system with portions broken away to show a relative humidity sensor and the cable construction.
Figure 10:
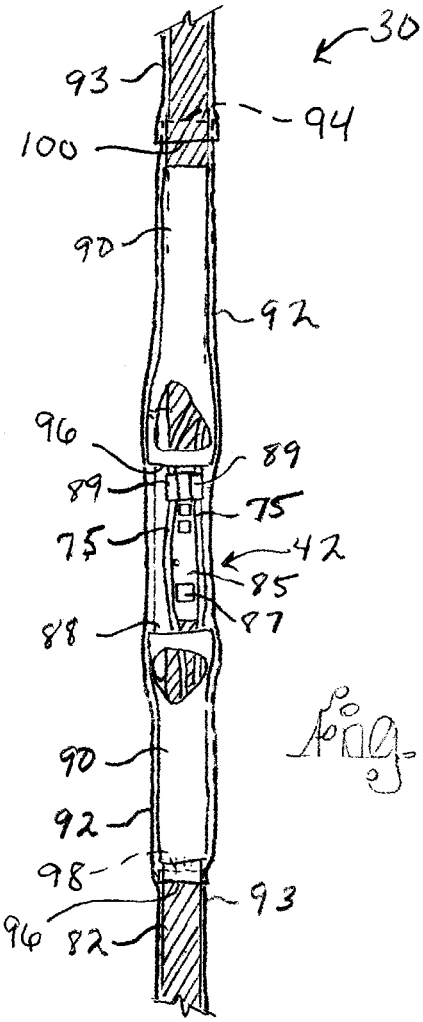
FIG. 10 is a fragmentary, front plan view of a temperature cable of the grain drying system with portions broken away to show a temperature sensor and cable construction.
Figure 15:
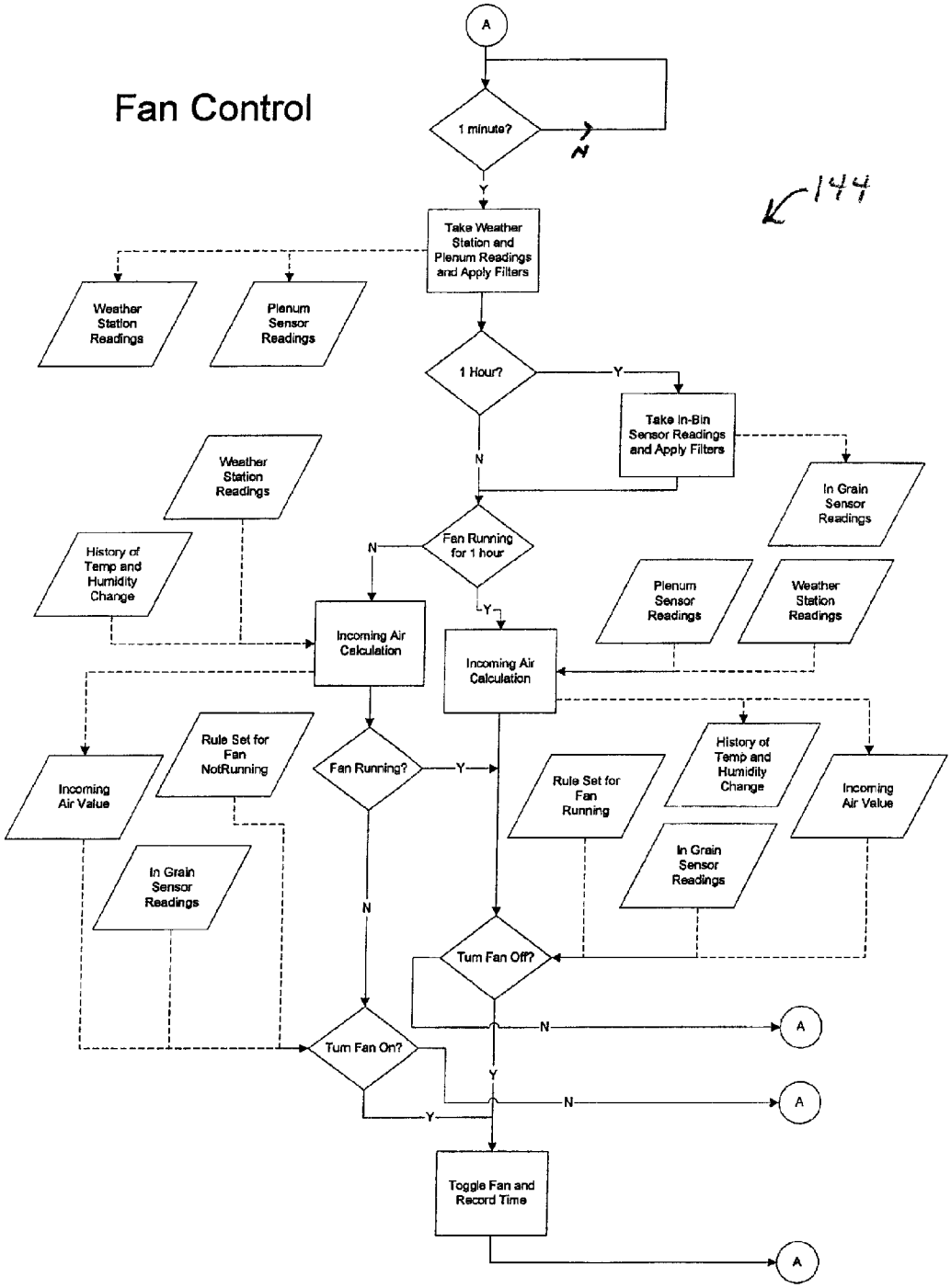
FIG. 15 is a flow chart showing the fan control processing of the grain drying system.

As shown in FIGS. 1 and 2, the in-bin natural or atmospheric air grain drying system 20 of the present invention includes a master control unit 22, distributed control units 24, 25 and 26, a relative humidity sensor cable or cable assembly 28, temperature sensor cables or cable assemblies 30, a plenum condition sensor assembly 32, a weather station 34, a radio or cellular modem 36 and a remote user interface 38. Additionally, as shown in FIGS. 7 and 10, in-grain condition sensor assemblies 40 and 42 are secured along the respective cables 28 and 30. Sensor assemblies 40 determine the relative humidity and the temperature of the grain 11 by measuring the temperature and the relative humidity of the air surrounding the individual granules of grain within the stored mass. Sensor assemblies 42 determine the temperature of the grain 11 again by measuring the temperature of the air surrounding the grain within the stored mass. FIG. 1 shows a group of nearby bins 10, each with the drying system 20 installed thereon, forming a cluster 21 of bins 10.

Each distributed control unit 24, 25 and 26 communicates with the master control unit 22. Depending on the conditions detected by the sensor assemblies 32, 40 and 42 and the weather station 34, and communicated to the master control unit 22, the master control unit 22 selectively activates the drying fan 16 when it is efficient and effective to do so to achieve and maintain the grain's selected EMC based upon a comparison of the detected conditions relating to external temperature and humidity and the temperature and humidity within the mass of grain to be dried. The measured temperature and humidity within the plenum 14 may also be factors used to determine fan operation. Generally, if the external relative humidity is lower than the relative humidity within the mass of grain and the external temperature relatively high, the master control unit 22 will activate the fan 16. The system 20 dries the grain 11 throughout the grain bin 10 to its selected EMC quickly and efficiently to help prevent over-drying or other grain degradation and allows for communication between the system 20 and the user with regard to the grain's condition.

Figure 5:
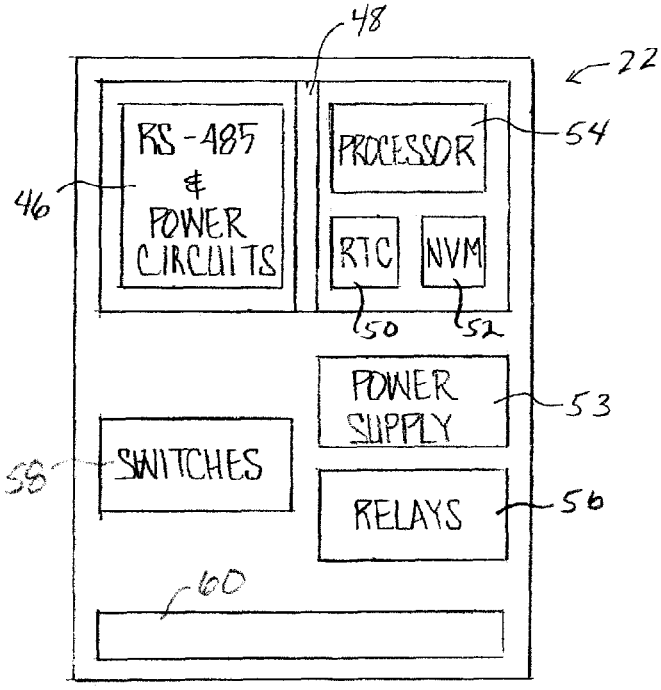
FIG. 5 is a front diagrammatic view of the master control unit of the grain drying system.

As shown in FIG. 2, the master control unit 22 is mounted on the exterior of the bin's side wall 12 near the fan 16 and at an easily accessible height from the ground. As shown schematically in FIG. 5, the master control unit 22 includes power circuitry 46, isolation circuitry 48, a real-time-clock 50, non-volatile memory 52, a power supply 53, a microprocessor and firmware 54, relays 56, switches 58 and a terminal block 60. The memory 52 stores the grain type and corresponding selected or desired EMC among other information as well as the time and date during periods when the system's input power supply 53 is off. The microprocessor and firmware 54 run the software instructions required for the fan processing. The isolation circuitry 48 extends between the power circuitry 46 and the clock 50, the memory 52 and the processor 54 to prevent damage to the connected devices in the case of an electrical surge. The relays 56 and switches 58 automatically activate the fan 16 through a pair of wires 62 that run between the master control unit's terminal block 60 and the fan 16.

The distributed control unit 24 is mounted on the roof of the grain bin 10 near the ends of the humidity and temperature cable assemblies 28 and 30. It controls the sensor assemblies 40 and 42 on up to eight cable assemblies 28 and 30 for determining the in-bin grain conditions. Distributed control unit 25 is mounted on the side wall of the grain bin 10 near the plenum sensor 32 for controlling the plenum sensor assembly 32 and the weather station 34 and determining the out-of-grain environment condition. The distributed control unit 26 is preferably mounted on the roof of the grain bin 10 near the radio/modem 36 and controls the local communication between bins 10 and the remote communication with the remote interface 38.

Figure 6:
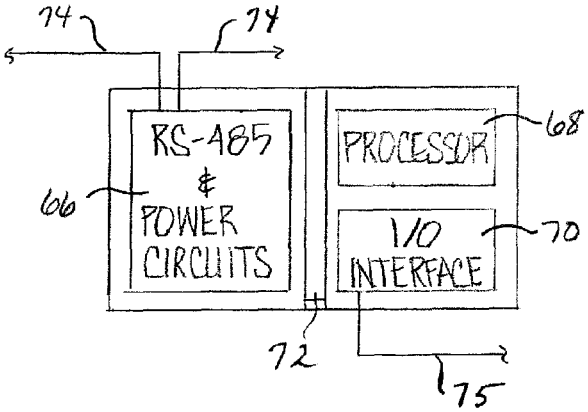
FIG. 6 is a front diagrammatic view of a distributed control unit of the grain drying system.

As shown schematically in FIG. 6, each distributed controller 24, 25 and 26 includes power circuitry 66, a microprocessor 68, an input/output interface with sensor or cell modem/radio circuitry 70 and isolation circuitry 72. Similar to the isolation circuitry 48 of the master control unit 22, the isolation circuitry 72 extends between the power circuitry 66, and the processor 68 and the I/O interface 70 to prevent damage to the connected devices in the case of an electrical surge. The distributed control units 24, 25 and 26 communicate with the master controller 22 via a pair of RS-485 communication wires 74.

As seen in FIG. 2, the wire pair 74 preferably connects the master control unit 22 and each of the distributed control units 24, 25 and 26 together in a daisy chain. The communication protocol parameters are: RS-485 for electrical signal levels; asynchronous 8-bit characters at 9600 baud with one start bit, one stop bit and no parity; and poll/response messaging where the master control unit 22 polls a specific distributed control unit 24, 25 or 26 for information and the distributed control unit 24, 25 or 26 sends a response. Each distributed control unit 24, 25 and 26 has an address assignment, so that each polling message contains an address field for the destination address, and each response contains an address field for the source address.

As seen in FIGS. 2 and 7, a wire pair 75 is secured along the cables 28 and 30 to communicate the grain conditions from the sensor assemblies 40 and 42 back to the controller 24. Similarly, the wires 75 interconnect the plenum sensor assembly 32 and the weather station 34 with the controller 25.

The sensor cables 28 and 30 include an upper end 76 and a lower end 77. The upper end 76 of the cables 28 and 30 is secured to and hangs vertically from the roof of the grain bin 10, with the lower ends 77 being spaced just above the perforated floor 15. The upper end 76 of the cables 28 and 30 is secured to an eyebolt 78. The eyebolt 78 is mounted through neoprene washers 80 and secured to the exterior side of the bin's roof 13 by a steel hanger 81 (only one shown in FIG. 2).

The cables 28 and 30 can be any desired length to fit within any grain bin 10. As shown, one relative humidity cable 28 hangs from near the center of the roof 13, with four temperature cables 30 spaced radially around the bin 10, between the relative humidity cable 28 and the wall of the bin 10. However, any number of cables 28 and 30 can be used and mounted in any configuration, as desired.

As seen in FIGS. 7 through 10, the cable assemblies 28 and 30 are similarly constructed in many respects. They each include the communication wires 75 mounted to extend along the length of a main support cable 82, with a group or string of sensor assemblies 40 or 42 secured in a spaced relationship along the wires 75 and the cable 82 as desired. However, it is preferable for the sensor assemblies 40 and 42 to be spaced approximately four feet apart along the cable's length. The cable 82 is preferably formed of a flexible, galvanized steel cable to provide each sensor cable assembly 28 and 30 sufficient strength. This is especially important when the grain 11 is added or removed from within the bin 10 which places the cables 28 and 30 under tremendous strain due to the pull on the cables 28 and 30.

The cables 28 and 30 are wrapped in protective tubing 92 and 93. The protective tubing 92 covers the sensor assemblies 40 and 42 and each assembly's corresponding length of the wires 75 and the cable 82, and the protective tubing 93 covers the length of the wires 75 and the cable 82 between adjacent sensor assemblies 40 and 42. The tubing 92 and 93 is preferably polyvinyl chloride (PVC) shrink tubing, with tubing 92 having a ½" diameter and tubing 93 having a ⅜" diameter.

Each segment of the tubing 92 has an upper end 94 and a lower end 96. Similarly, each segment of the tubing 93 has an upper end 98 and a lower end 100. The cable assemblies 28 and 30 are preferably constructed from their lower end 77 to their upper end 76, with the upper ends 98 of the tubing segments 93 being overlapped by the lower ends 96 of the tubing segments 92 and the upper ends 94 of the tubing segments 92 being overlapped by the lower ends 100 of the tubing segments 93. This construction prevents any grain 12 from becoming lodged in the cables 28 and 30 as it is deposited or removed from the bin 10.

The sensor assemblies 40 and 42 do differ from one another. The sensor assemblies 40 are mounted along the relative humidity cable 28 and include a sensor circuit board 84 having both a relative humidity (or moisture level) sensor 86 and a temperature sensor 87 thereon, whereas the sensor assemblies 42 are mounted along the temperature cables 30 and include a sensor circuit board 85 having a temperature sensor 87 thereon but no relative humidity sensor 86. The circuit boards 84 and 85 are shown in FIGS. 14 and 13 respectively. Up to thirty sensors 86 and 87 can be attached to the same cable assembly 28 or 30. Thus, as shown in FIG. 2, the center relative humidity cable 28 detects moisture and moisture differences between vertical layers of the grain 11 in the bin 10, and all of the cables 28 and 30 detect temperature and are useful in finding hot spots or areas in which the grain 11 may be undergoing a chemical change or degradation.

Figure 8:
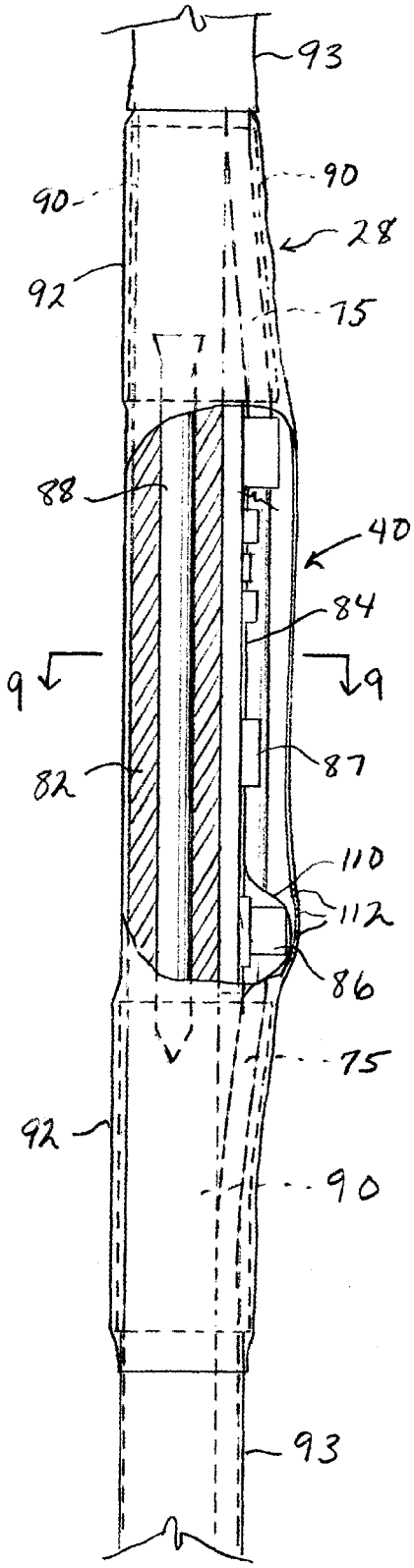
FIG. 8 is an enlarged, and fragmentary side view of the relative humidity cable of FIG. 7, with portions broken away to show a relative humidity sensor.

Referring to FIG. 8, each relative humidity sensor 86 is covered with a mesh filter 110. The filter 110 overlays the sensor 86. The filter 110 helps prevent dust or grain particulate from damaging the sensor 86 and is preferably a very thin, fine polypropylene mesh material.

Figure 9:
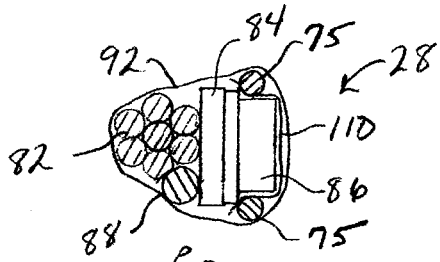
FIG. 9 is a cross-sectional view taken at detail 9-9 of FIG. 8, with the humidity sensor board shown in full for clarity.

Each sensor assembly 40 and 42 overlays a steel rod or nail 88 secured in place by two pieces of shrink tubing 90. As best seen in FIG. 9, the sensor circuit boards 84 or 85 lay over the steel cable 82 and the rod 88, which provide parallel supports for the circuit board 84 or 85. The combined diameters of the cable 82 and the rod 88 are preferably substantially equal to the width of the circuit boards 84 or 85. The wires 75 are secured by crimping them to the circuit boards 84 and 85 with fasteners 89. This also aids in securing the circuit boards 84 and 85 in place. With the relative humidity sensor assembly 40, the wires 75 lie along opposite sides of the relative humidity sensor 86 and over the mesh filter 110, thereby securing the mesh filter 110 in place and providing protection to the sensor 86.

The rod 88 is preferably steel and three inches in length. It lies along and parallel to the cable 82 below the circuit board 84 or 85 and thereby provides rigidity to the cable assembly 28 or 30 where the sensor circuit board 84 or 85 lays so that the board 84 or 85 bears little, if any, shear force when the sensor cable assembly 28 or 30 is moved or rolled prior to installation or when jarred by grain 11 as the bin 10 is filled or emptied. Although nails are readily available, any rigid rod-like member may be substituted or utilized.

The tubing pieces 90 secure the wires 75 and each end of the rod 88 to the cable 82 adjacent the ends of the sensor circuit board 84 or 85, sandwiching the circuit boards 84 or 85 therebetween. Polyolefin shrink tubing is preferred because it has an integral adhesive that melts into the braiding of the steel cable 82 to secure and affix the wires 75, the cable 82 and the rod 88 together.

The shrink tubing 92 secures the circuit boards 84 or 85 to the cable 82. The tubing 92 extends around the cable 82, the circuit board 84 or 85, the wires 75, the rod 88 and the polyolefin shrink tubing 90 to secure these elements together and provide abrasion resistance. As best seen in FIG. 8, with the relative humidity sensor assembly 40, the tubing 92 has apertures 112 therethrough. These apertures 112 are aligned over the relative humidity sensor 86 to allow air and moisture to exchange and equalize through the mesh filter 110 and the apertures 112, between the sensor 86 and the grain 11. As shown in FIG. 8, the tubing 92 includes three small apertures 112; however, the number of apertures may be varied.

As generally shown in FIG. 2, the cable assemblies 28 and 30 with sensor assemblies 40 or 42 mounted thereon are suspended from the ceiling of the bin 10 and extend toward the floor 15 prior to filling the bin 10 with grain 11. The bin 10 is then filled with grain 11 so that the cable assemblies 28 and 30 with sensor assemblies 40 and 42 mounted thereon extend into the mass of the stored grain 11. Air voids are formed between the individual seeds or grains 11, and it is the relative humidity and temperature of the air in the voids that is measured by the sensor assemblies 40 and 42 to determine the moisture content of the grain 11.

As seen in FIGS. 2 and 11, the plenum sensor assembly 32 is mounted in and extends through the side wall 12 of the grain bin 10 into the plenum chamber 14. The plenum sensor assembly 32 includes a breathable plastic tube 116 with both relative humidity and temperature sensors 118 and 120 mounted therein to measure the temperature and the moisture content of the air being pushed into the grain 11 by the fan 16. The plenum sensor assembly 32 also includes an air pressure tube 122 for conducting the air pressure within the plenum chamber 14 to the distributed control unit 25 where it is measured. This allows the system to determine if the fan 16 is running. Also, if the grain 11 within the bin 10 is very wet, the air pressure increases.

The weather station 34 is shown in FIGS. 1, 2 and 12. The weather station 34 includes a pair of sensor boards (not shown) for measuring the relative humidity and air temperature outside the grain bin 10. The sensor boards are mounted within a breathable plastic tube 130 and a vented radiation shield 132 to protect them from the environment. Preferably, the weather station 34 is colored white to reflect the sun's rays and is mounted to the exterior side wall 12 of the grain bin 10 away from the fan 16 to obtain the most accurate readings.

It is most preferable for the system 20 to include both the plenum sensor 32 and the weather station 34 as described to obtain the most accurate measurements for optimum drying. For instance, the measurements taken by the plenum sensor 32 and the weather station 34 may differ given the heat added to the air in the plenum chamber 14 as a result of the air movement through the fan 16, the increased pressure in the plenum chamber 14 and the heat given up or absorbed by the ground that forms nearly half of the plenum chamber 14 surface area. However, one weather station 34 may be adequate for a cluster 21 of nearby bins 10.

The cellular modem or low power local radio 36 is preferably mounted on the bin's roof 13 for the most effective signal transmission. If a cellular modem 36 is included, then its antenna 134 is mounted nearby. As shown in FIG. 2, the antenna 134 is mounted on the roof 13 of the grain bin 10. For cost savings, one cellular modem 36 and weather station 34 may be shared among a cluster 21 of bins 10, with each of the other systems 20 on nearby bins 10 using a low power radio 36, to provide the local communication between the bins 10 and the cellular modem providing the remote communication from the cluster 21.

OPERATION

The master control unit 22 controls the operation of the bin's fan 16 (and heater, if installed) using the closed loop control system shown in FIG. 4. The system's input 138 is the grain type and the desired or selected EMC and temperature. These are entered by the user at the master control unit 22 or through the remote user interface or computer 38. These settings 138 may be determined and set once per season or updated frequently. The settings 138 are stored in the master control unit's non-volatile memory 52 so that the system 20 can operate without continual intervention or even a connection to a user or outside computer. The system's output 140 is the actual EMC and temperature.

The sensor processing 142 and 146 is partially performed in the distributed control units 24 and 25 before being passed to the master control unit 22 for completion. The distances between the sensor assemblies 32, 34, 40, and 42 and the distributed control units 24 and 25 are made relatively short to reduce the susceptibility of the electrical signals between them to electromagnetic interference. Accordingly, in the preferred embodiment, some of the sensor processing is done at the distributed control units 24 and 25 which are mounted around the exterior of the grain bin 10 in relatively close proximity to the sensor assemblies 32, 34, 40 and 42. That part of the sensor processing 142 and 146 that is done in distributed control units 24 and 25 is to verify the integrity of the sensor data, to perform averaging, and to convert it to a form that can be used by the master control unit 22.

The cable assemblies 28 and 30 are powered by the distributed control unit 24 one at a time. The control unit 24 sends commands to the circuit board 84 or 85 on the powered cable 28 or 30 by switching off and on the power on that cable 28 or 30. Switching between the two states, on and off, provides the digital communication. Each circuit board 84 or 85 contains an address that is also a relative location of the circuit board 84 or 85 on the cable assembly 28 or 30. For example, the circuit board 84 or 85 farthest from the distributed control unit 24 has an address of "1". The circuit board 84 or 85 next closest to the distributed control unit 24 has an address of "2" and so on. The addresses differentiate one circuit board 84 or 85 from another on the same cable assembly 28 or 30.

The messages communicated from the distributed control unit 24 to the sensors 86 and 87 are called commands and every command contains the address of the destination sensor 86 or 87. Every message from circuit board 84 or 85 to the distributed control unit 24 is a response, and every response contains the source address of the circuit board 84 or 85. The circuit board 84 or 85 creates a response by switching a load on and off while the distributed control unit 24 has the voltage at its high level. Thus, the current changes between a low current and a high current and is detected by a current circuit of the distributed control unit 24.

When the distributed control unit 24 is not communicating with a particular string of sensor assemblies 40 or 42 on a cable assembly 28 or 30, it leaves the power off on that cable 28 or 30. Thus, the sensors' microprocessors are reset each time the power is applied before another measurement and communication event. While the distributed control unit 24 transmits by switching power off for brief periods, capacitors on the sensor boards 84 or 85 keep the sensors' circuitry active.

Both local communication between systems 20 on nearby bins 10 and remote communication with a remote user interface 38 are coordinated through the distributed control unit 26. This distributed control unit 26 communicates with the system's low power local radio or cellular modem 36.

Remote communication includes communication from the system 20 to the remote user interface 38 as well as communication from the remote user interface 38 to the system 20. For instance, daily status reports containing the hourly temperature and moisture content, the time the fan 16 has operated and other data that is of interest to a user who may be monitoring system performance is transmitted from the system 20. Remote communication also includes the transmission of alarm conditions, which can be displayed through the browser and/or communicated to the user via text message, telephone or e-mail. Lastly, remote communication includes incoming messages from the remote user interface 38 for purposes of changing system inputs 138, such as the grain or commodity type, desired temperature and desired EMC.

Local communication includes collecting and distributing remote communication when only one cell modem 36 is installed in a cluster 21 of nearby bins 10. It also includes the distribution of information from the weather station 34 when one weather station 34 is installed in a cluster 21 of bins 10.

Having thus described the invention what is claimed as new and desired to be secured by Letters Patent is as follows:

1. A condition sensing system for a grain drying system, the condition sensing system comprising:

a plurality of condition sensing cable assemblies for hanging to extend substantially vertically in a grain storage bin, said assemblies each including a flexible support cable and a data-conveying member extending continuously along the length of said assemblies; and at least one of said condition sensing cable assemblies having a plurality of humidity sensor assemblies mounted on the support cable in a spaced apart relationship along the length of the support cable and between first and second ends thereof, said humidity sensor assemblies each including an elongate, rigid sensor support member disposed in a substantially vertical orientation extending parallel to said support cable, a humidity sensor disposed on a sensor circuit board, said sensor support member substantially protecting said humidity sensor and said sensor circuit board from exposure to shear forces applied to the condition sensing cable assembly, and a protective covering extending around said support cable, said data-conveying member, said sensor support member, said humidity sensor, and said sensor circuit board, the support cable and the data-conveying member passing through the protective covering to extend from each end thereof, said data-conveying member providing a common communicative coupling to each of said humidity sensor assemblies disposed on the support cable for communicating humidity data from each of said humidity sensors to the grain drying system.

2. The condition sensing system of claim 1, wherein each said covering includes an opening therethrough substantially aligned with said corresponding humidity sensor to facilitate said humidity sensor's humidity determination.

3. The condition sensing system of claim 1, wherein at least one said condition sensing cable assemblies has a plurality of temperature sensor assemblies mounted thereon in a spaced apart relationship along the cable's length, said temperature sensor assemblies each including an elongate, rigid sensor support member, a temperature sensor, and a protective covering member extending around said cable, said data-conveying member, said sensor support member and said temperature sensor.

4. The condition sensing system of claim 1, wherein each condition sensing cable assembly further comprises:

a second protective covering extending around said support cable and said data-conveying member between adjacent sensor assemblies, a lower end of said first protective covering extending over an upper end of said second protective covering and a lower end said second protective covering extending over the upper end of the first protective covering, to further protect the sensor from grain particulate.

5. The condition sensing system of claim 2, further comprising:

a filter member sandwiched between each said humidity sensor and each said protective covering opening, to protect said humidity sensors from particulate matter.

6. A method of drying grain stored in a grain bin having a drying fan for forcing unconditioned natural air upwards through said grain comprising the steps of:

connecting a master control unit to the drying fan;

inputting a desired grain equilibrium moisture content into the master control unit;

hanging at least one relative humidity sensor cable assembly in the bin in which grain is to be stored, said relative humidity sensor cable assembly including a support cable, a pair of wires extending along the length of the support cable, and a plurality of relative humidity sensors mounted in vertically spaced apart relation on the support cable and communicatively coupled to the pair of wires, each of the plurality of relative humidity sensors having a rigid support member disposed adjacent thereto and being enclosed by a cover that surrounds a portion of the support cable, a portion of the pair of wires, the relative humidity sensor, and the rigid support member, the support cable and the pair of wires passing continuously through the cover to extend from each end thereof;

filling the bin with grain, after hanging the at least one relative humidity sensor cable assembly therein, to a level such that said plurality of relative humidity sensors are surrounded by grain in the bin;

selectively determining a set of out-of-grain conditions, including an external temperature and an external relative humidity of air outside the grain bin;

selectively determining a set of in-grain conditions, including an in-grain relative humidity of the air surrounding the grain surrounding each of said relative humidity sensors respectively;

communicating the set of out-of-grain conditions and the set of in-grain conditions to a master control unit; and selectively operating the drying fan depending on an analysis of the set of in-grain conditions and the set of out-of-grain conditions, to dry the grain to the desired grain equilibrium moisture content.

7. A grain drying system for a grain bin holding grain in a plurality of vertically spaced zones, comprising:

a grain bin fan selectively operable by a primary controller to blow air from outside the grain bin up through the grain held in the grain bin to drive a moisture content of the grain to a selected grain moisture content;

a relative humidity sensing cable assembly comprising a first flexible support cable having a plurality of relative humidity sensor assemblies mounted thereon in spaced apart relation and a pair of electrical conductors extending along the length of the relative humidity sensing cable assembly, the first support cable vertically supporting the relative humidity sensor assemblies against downward movement caused by a downward flow of grain contacting the relative humidity sensor assemblies, said relative humidity sensing cable assembly hanging within the grain bin and extending into a grain storage area of the grain bin in which grain is to be stored such that said relative humidity sensor assemblies extend in vertically spaced relation in the grain storage area of the grain bin such that grain stored in said grain bin to a level above one of said relative humidity sensor assemblies extends completely around said relative humidity sensor assembly, each of said relative humidity sensor assemblies including a relative humidity sensor secured within a tubular enclosure surrounding said relative humidity sensor, said first support cable and said first pair of electrical conductors with said first cable and said first pair of electrical conductors extending continuously through said tubular enclosure to extend from each end thereof, said relative humidity sensor being in electrical communication with said first pair of electrical conductors, and said tubular enclosure having at least one opening extending therethrough extending in communication with said relative humidity sensor; each of said relative humidity sensors sensing an in-grain relative humidity value of air surrounding the grain surrounding said respective relative humidity sensor;

an external condition sensing assembly, mounted outside of the grain bin for determining an external air temperature and an external relative humidity value of air outside of said grain storage area of the grain bin;

means for communicating the in-grain relative humidity values via said first pair of electrical conductors, the external relative humidity value and the external air temperature to said primary controller;

said primary controller performing a comparison of the in-grain relative humidity values to the external relative humidity value and the external air temperature and activating said fan when one of a selected set of rules relating to said comparison are met.

8. The grain drying system as in claim 7, further comprising:

a temperature sensing cable assembly comprising a second support cable and a second pair of electrical conductors and having a plurality of temperature sensors mounted thereon in spaced apart relation; said second support cable assembly hanging within the grain bin and extending into said grain storage area such that each of said temperature sensors extends in a different one of the plurality of vertically space zones of the grain in the grain bin and each of said temperature sensors is surrounded by grain; each of said temperature sensors measuring an in-grain temperature of air surrounding the grain surrounding said respective temperature sensor;

means for communicating the in-grain temperature measured by each of said temperature sensors via said second pair of electrical conductors to said primary controller for use by said primary controller in determining whether one of the selected set of rules has been met to activate said fan.

9. A relative humidity sensing cable assembly for use in association with an in-bin grain drying system for grain in a grain bin, said cable assembly comprising:

a support cable having a plurality of relative humidity sensor assemblies mounted on the support cable in spaced apart relation along its length and a conductor member extending along at least a portion of the length of support cable and between each of the plurality of relative humidity sensor assemblies;

said support cable having a first end securable within said grain bin above a grain storage area of the grain bin in which grain is stored;

said support cable sized to hang into a plurality of vertically spaced zones of grain held in said grain storage area such that each of said relative humidity sensor assemblies extends in a different one of the plurality of vertically space zones;

each of said relative humidity sensor assemblies including a relative humidity sensor secured within a tubular enclosure surrounding said relative humidity sensor, said support cable and said conductor member and having at least one opening extending therethrough in communication with said relative humidity sensor, each of said relative humidity sensors being electrically coupled to said conductor member, and said support cable and said conductor member passing through the tubular enclosure to extend from each end thereof;

each of said relative humidity sensors sensing an in-grain relative humidity value of air surrounding grain surrounding said respective relative humidity sensor.

10. The relative humidity sensing cable assembly as in claim 9, wherein each of said relative humidity sensor assemblies includes a filter positioned between said relative humidity sensor and said enclosure and extending across said at least one opening extending through said enclosure.

11. The relative humidity sensing cable assembly as in claim 9, in combination with a controller, wherein said conductor member comprises a pair of wires connected between each of said relative humidity sensors and to said controller.

12. The condition sensing system of claim 1, wherein the humidity sensor is mounted on a circuit board and the data-conveying member is communicatively coupled to the circuit board.

13. The condition sensing system of claim 12, wherein the circuit board is disposed between the support cable and the data-conveying member and the data-conveying member aids protecting and supporting of the circuit board on the support cable.

14. The condition sensing system of claim 1, wherein the sensor support member is disposed alongside the support cable and the humidity sensor to restrict bending of the support cable adjacent to the humidity sensor.

15. The condition sensing system of claim 1, wherein the data-conveying member provides communication with each of the humidity sensor assemblies disposed on a particular one of the plurality of condition sensing cable assemblies, and each of the humidity sensor assemblies includes a unique address for communicating therewith.

16. The method of claim 6, further comprising at least partially emptying and refilling the grain bin subsequent to hanging the at least one relative humidity sensor cable assembly, the at least one relative humidity sensor cable assembly remaining in an installed position in the bin during the emptying and refilling.

17. A condition sensing system for a grain drying system, the condition sensing system comprising:

a plurality of condition sensing cable assemblies for hanging in a grain storage bin, said assemblies each including a flexible support cable and a data-conveying member extending continuously along the length of said assemblies;

at least one of said condition sensing cable assemblies having a plurality of humidity sensor assemblies mounted thereon in a spaced apart relationship along the length of the support cable and between first and second ends thereof, said humidity sensor assemblies each including an elongate, rigid sensor support member disposed to extend parallel to said support cable, a humidity sensor, and a protective covering extending around said support cable, said data-conveying member, said sensor support member and said humidity sensor, the support cable and the data-conveying member passing through the protective covering to extend from each end thereof, said data-conveying member communicatively coupling to each of said humidity sensor assemblies disposed on the support cable for communicating humidity data from each of said humidity sensors to the grain drying system; and communication means mounted to each said humidity sensor assembly for communicating said humidity from each said humidity sensor to the grain drying system.

* * * * *